United States Patent [19]

Yoshinaga et al.

[11] Patent Number: 4,544,113

[45] Date of Patent: Oct. 1, 1985

[54] PACKAGE OF CARBONACEOUS FILAMENT STRAND

[75] Inventors: Minoru Yoshinaga; Nobuyuki Matsubara, both of Ehime, Japan

[73] Assignee: Toray Industries, Inc., Tokyo, Japan

[21] Appl. No.: 570,211

[22] Filed: Jan. 12, 1984

[30] Foreign Application Priority Data

Jan. 18, 1983 [JP] Japan ..... 58-6068

[51] Int. Cl.[4] ..... B65H 54/28; B65H 55/04

[52] U.S. Cl. ..... 242/178; 242/43 R; 242/158.5

[58] Field of Search ..... 242/174, 175, 176, 177, 242/178, 18.1, 43 R

[56] References Cited

U.S. PATENT DOCUMENTS

| | | | |
|---|---|---|---|
| 3,310,248 | 3/1967 | Have | 242/176 X |
| 3,690,579 | 9/1972 | Porter et al. | 242/18.1 X |

FOREIGN PATENT DOCUMENTS

| | | | |
|---|---|---|---|
| 139975 | 8/1983 | Japan | 242/43 R |
| 35956 | 6/1938 | Netherlands | 242/43 R |
| 1038896 | 8/1966 | United Kingdom | 242/174 |

*Primary Examiner*—Stuart S. Levy
*Assistant Examiner*—Katherine Jaekel
*Attorney, Agent, or Firm*—Austin R. Miller

[57] ABSTRACT

A package of a carbonaceous filament strand in the form of a square-end cheese, which is free from "thread dwell" on the shoulders of the package. The package is formed by distributing turning points of the traverse motions in the area near the package ends. Such distribution of the turning points is achieved by repeating two to six kinds of strokes in a cycle of successive traverse motions. The difference between the maximum and the minimum strokes is preferably within a range of 2% to 20% relative to the maximum stroke.

6 Claims, 7 Drawing Figures

PACKAGE OF CARBONACEOUS FILAMENT STRAND

BACKGROUND OF THE INVENTION (1) Field of the Invention

The present invention relates to a package of a carbonaceous filament strand.

(2) Description of the Prior Art

A carbonaceous filament strand is conventionally produced by preliminarily heating an organic polymer filament, such as polyacrylonitrile filament, cellulosic filament, or pitch filament, in an oxidizing atmosphere and then carbonizing or graphitizing it in a high temperature oven in an inert atmosphere. The carbonaceous filament strand thus obtained is wound on a bobbin in a square-end cheese package for easy unwinding.

Recently, a demand has arisen for larger packages of 1 kg or more, sometimes as much as 10 kg, in order to save labor in the winding process and cut down on packaging costs and transportation expenses. It is very difficult, however, to produce large packages of carbonaceous filament strand.

To obtain a square-end cheese package of conventional synthetic filament yarn, a spindle-drive winder is generally utilized. In such a winder, the yarn is wound on a bobbin fitted onto a spindle shaft through a traverse guide reciprocated along the spindle shaft within a constant travelling width. In this case, so-called "thread dwell" occurs on the shoulders of the resultant package, corresponding to the turning points of the traverse motion of the traverse guide. The "thread dwell" tends to cause yarn slip-over from the shoulder of the package after the winding operation or prevents smooth unwinding of the yarn from the resultant package. Further, in case of the carbonaceous filament strand package, the thread dwell causes a deterioration of the package qualities, particularly, of the strength of the strand located at the shoulder portion.

In one method of eliminating the "thread dwell", a pressure roll is provided in the winder parallel to the spindle shaft. The pressure roll maintains light contact with the package surface, the spindle shaft gradually moving away from the pressure roll as the package enlarges. Any "dwell" is therefore pressed by the pressure roll to flatten the package surface.

While this method is effective for winding conventional synthetic filament yarn, it is not that applicable to a carbonaceous filament strand. A carbonaceous filament strand has a higher Young's modulus, a lower elongation, and an extremely weak bending strength compared to conventional synthetic filament yarn such as polyester or polyamide. Accordingly, when the thread dwell is pressed by the pressure roll, though the package surface becomes flat, filaments in the strand of the dwell portion are damaged, causing degradation of strength and generation of fluff. It is therefore important to eliminate thread dwell in a carbonaceous filament strand package without damaging the filament quality.

SUMMARY OF THE INVENTION

Accordingly, an object of the present invention to provide an improved package of carbonaceous filament strand having none of the drawbacks described above.

The object of the present invention can be achieved by a package of a carbonaceous filament strand in the form of a square-end cheese consisting of layers of strand coils. The package is formed by winding a carbonaceous filament strand on a bobbin while moving the strand back and forth along the axis of the bobbin by successive traverse motions, the traverse motions being repeated in a cycle after a predetermined number of such motions. In each cycle, two to six different transverse stroke lengths are combined.

The difference between the longest stroke length and the shortest stroke length is preferably within a range of from 2% to 20% of the longest stroke length of stroke.

BRIEF DESCRIPTION OF THE DRAWINGS

Other features and advantages of the present invention will be apparent from the following description with reference to the accompanying drawings, wherein.

DESCRIPTION OF THE PREFERRED EMBODIMENTS

Figure 1:
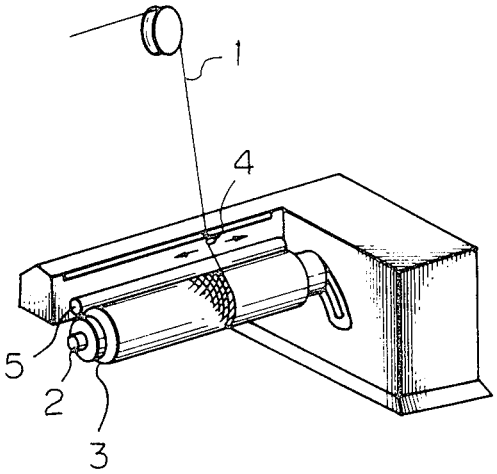
FIG. 1 is a perspective view of a conventional spindle-drive wider utilized for forming a yarn package the present invention.

The package of carbonaceous filament strand according to the present invention can be produced by a conventional spindle-drive winder as illustrated in FIG. 1, in which a carbonaceous filament strand 1 such as carbon filament or graphite filament is wound on a bobbin 3 fitted onto a spindle shaft 2 through a traverse guide 4 reciprocated along the spindle shaft 2 within a constant travelling width. Reference numeral 5 indicates the pressure roll. The pressure roll 5, however, is optional in the invention.

The package is composed of a plurality of layers of strand coils formed by repeated traverse motions. Each traverse motion consists of two traverse strokes, one forward and one backward. The traces of the strokes turn at the package end portions. As is the case of a conventional package, if successive traces turn at the same points at the package end portions, a "thread dwell" is formed on the package shoulders. In the present invention, there are a plurality of turning points distributed over a certain area near the package end portions. Such an arrangement of turning points is achieved by programming the traverse motions to repeat in a cycle after a predetermined number of such motions. In each cycle, at least two different lengths of strokes are combined. Here, the "length" of a stroke means the traverse width from one turning point to the next.

Figure 2A:
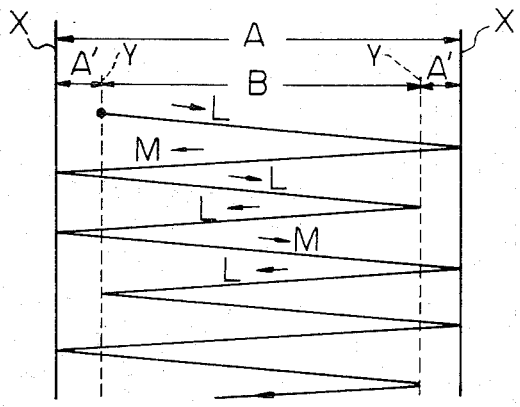
FIGS. 2A and 2B diagrammatically illustrate examples of course of traversing strokes during winding operations for producing a package according to the present invention.
Figure 2B:
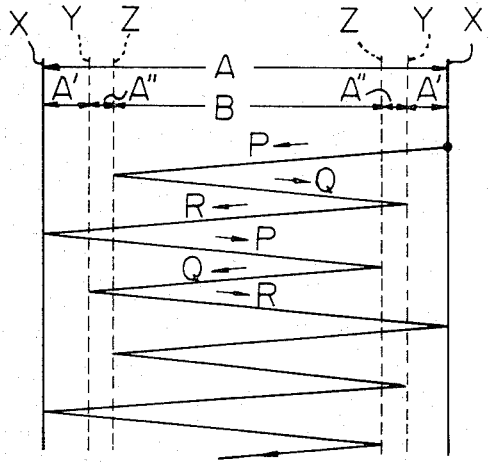

Typical traces of the strokes according to the above traverse motion are illustrated in FIGS. 2A and 2B. In FIG. 2A, two turning points are provided on each package end portion, a first point X just on the outer end and a second point Y a distance A' inside thereof. This is achieved by repetition of two kinds of strokes having lengths L and M, respectively, in a manner of L M L L M L, where the arrows show the moving direction. In FIG. 2B, a further turning point Z is arranged a distance A″ inside of the point Y. This is achieved by repetition of three kinds of strokes having lengths P, Q, and R, respectively, in a manner of P Q R P Q R.

The difference of the length of the maximum stroke from that of the minimum stroke must be within a range of from 2% to 20% relative to the former. In this connection, in FIG. 2A, the maximum stroke M corresponds to a distance [A] and the minimum stroke corresponds to a distance [A−A′], while in FIG. 2B, the maximum stroke R corresponds to a distance [A−A′] and the minimum stroke Q corresponds to a distance [A−(2A′+A″)].

More than three types of strokes can also be adopted to provide more turning points and, thereby further improve the package style, however, more than six kinds of strokes is not preferable because it would overly complicate the mechanism for attaining such strokes and, in addition, might result in package defects such as "slip over" or "cob-webbing".

The above-mentioned combination of strokes can be achieved by providing, for example, a scroll cam for the traverse guide. The scroll cam has a plurality of grooves, each groove corresponding to one of the strokes. The traverse guide is engaged with the appropriate groove in accordance with a traverse program. Such a scroll cam can easily be designed by a person skilled in the art by referring to, for example, U.S. Pat. No. 1,957,979 or 3,718,288, so further explanation thereof is omitted.

A package of carbonaceous filament strand according to the present invention is freed from "thread dwell" by just varying the combination of the strokes of the traverse motions even without the application of the pressure roll. Accordingly, damage to the filament in the strand wound on the package can completely be avoided while maintaining the package style in good condition.

Features and advantages of the present invention will be understood more clearly from the following experiment.

Experiment

Figure 3A:
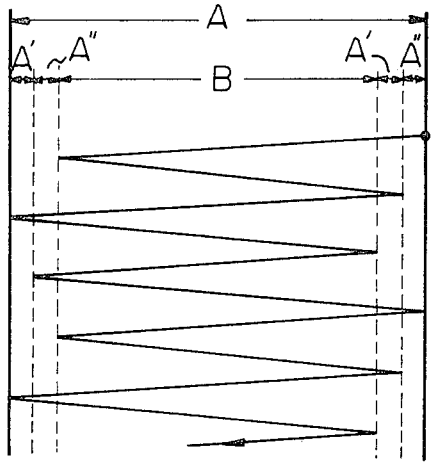
FIG. 3A illustrates another example of a course of traversing strokes during a winding operation for producing a package of the present invention.

Using the same type of winder as illustrated in FIG. 1, a graphite strand of 3,000 filaments with a total thickness of 1,500 denier was wound on a bobbin of 85 mm outer diameter to form a square-end cheese package No. 1 with a maximum width of 150 mm by controlling the traverse motions as illustrated in FIG. 3A, where A′=A″=5 mm. The original graphite strand had a strength of 18 kg and the number of fluffs of 10/m.

Figure 3B:
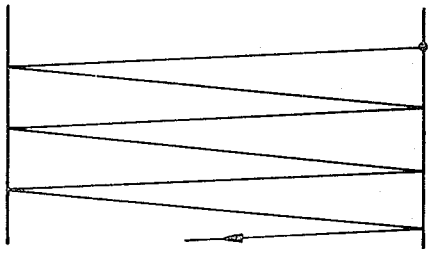
FIG. 3B illustrates a course of traversing strokes during a winding operation for producing a conventional package.

As a control, a package No. 2 was wound from the same filament strand in a similar manner as the package No. 1 except that the stroke is maintained at a constant length of 150 mm, as shown in FIG. 3B.

The other winding conditions were as follows:

Package weight: 2.0 kg

Package diameter: 160 mm

Winding ratio: 4.33

Winding tension (initial/final): 0.1/0.07 g/D

Helical angle (initial/final): 15/8°

Quality tests on the resultant packages showed that package No. 2 (control) was poor in unwinding smoothness relative to package No. 1 (present invention) though the former exhibited as good an appearance as the latter. The unwinding smoothness is substantially equivalent to the degree of fluff of the filament in the package.

The strand strength and the number of fluffs were measured on various portions of package Nos. 1 and 2 along the package width.

Figure 4A:
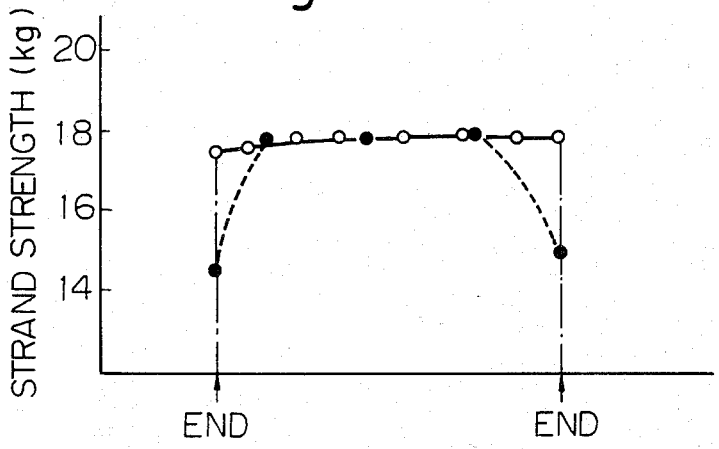
FIGS. 4A and 4B are graphs of strand strength and number of fluffs, respectively.
Figure 4B:
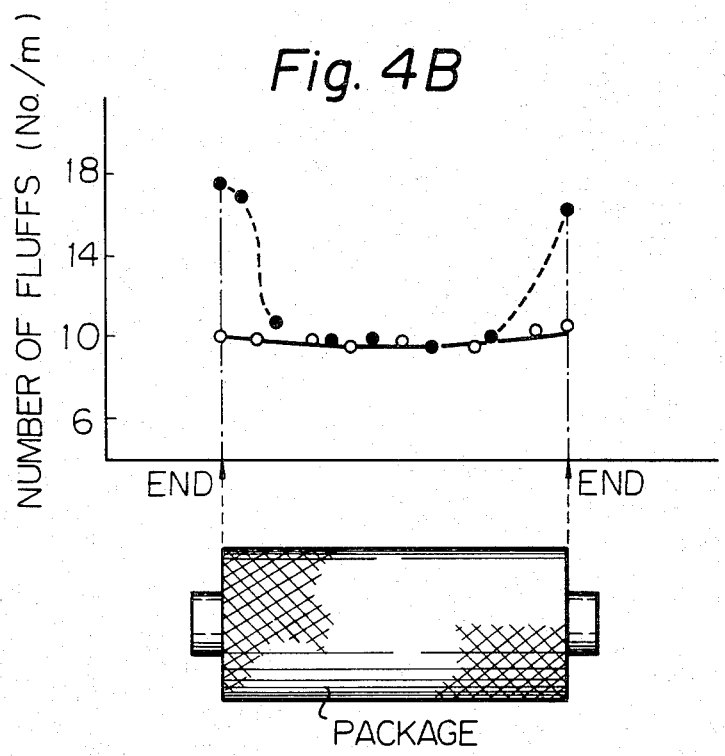

The results are illustrated in FIGS. 4A and 4B, respectively, where the white dots represent package No. 1 (present invention) and the black represent package No. 2 (control). As is apparent from the graphs, the filament laid on the end portion of package No. 2 as damaged by the application of the pressure roll. On the contrary, package No. 1 exhibited uniformly good qualities throughout the package.

We claim:

1. A package of a continuous carbonaceous filament strand wound in reversing layers of helical coils on a bobbin to form a square-end cheese, wherein the coils are laid down by traversing strokes of two unequal lengths to form a plurality of longer coil layers and a plurality of shorter coil layers, the difference between the lengths of the longer and the shorter coil layers being in the range of from 2% to 20% of the length of the longer coil layers, and the longer coil layers being the same length as the package, and the coil layers are laid down by reversing traverse strokes in a repeated pattern consisting of, in order, a longer coil layer, a shorter coil layer, and a second shorter coil layer.

2. A package of a continuous carbonaceous filament strand wound in reversing layers of helical coils on a bobbin to form a square-end cheese, wherein the coils are laid down by traversing strokes of three unequal lengths to form a plurality of longer coil layers, a plurality of intermediate length coil layers, and a plurality of shorter coil layers, all of the coil layers being shorter than the length of the package and the difference between the lengths of the longer and the shorter coil layers being in the range of from 2% to 20% of the length of the longer coil layers, and the coil layers are laid down by reversing traverse strokes in a repeated pattern consisting of, in order, an intermediate length coil layer, a shorter coil layer, and a longer coil layer.

3. A package according to claim 1, in which said carbonaceous filament strand is a carbonized polyacrylonitrile synthetic filament.

4. A package according to claim 3, in which said carbonaceous filament strand is a carbon filament strand.

5. A package according to claim 3, in which said carbonaceous filament strand is a graphite filament strand.

6. A package according to claim 1 or 2, in which said carbonaceous filament strand is a carbonized pitch fiber filament.

* * * * *

UNITED STATES PATENT AND TRADEMARK OFFICE

CERTIFICATE OF CORRECTION

PATENT NO. : 4,544,113

DATED : October 1, 1985

INVENTOR(S) : Minoru Yoshinaga; Nobuyuki Matsubara

It is certified that error appears in the above-identified patent and that said Letters Patent is hereby corrected as shown below:

Column 2, line 68, delete "L M L L" and insert --$\overset{\rightarrow}{L}\ \overset{\leftarrow}{M}\ \overset{\rightarrow}{L}\ \overset{\leftarrow}{L}$--.

Column 3, line 1, delete "M L" and insert --$\overset{\rightarrow}{M}\ \overset{\leftarrow}{L}$--.

Column 3, line 5, delete "P Q R P Q R" and insert --$\overset{\leftarrow}{P}\ \overset{\rightarrow}{Q}\ \overset{\leftarrow}{R}\ \overset{\rightarrow}{P}\ \overset{\leftarrow}{Q}\ \overset{\rightarrow}{R}$--.

Column 4, line 48, after "1" insert --or 2--.

Signed and Sealed this

*Twenty-fourth* Day of *June 1986*

[SEAL]

*Attest:*

DONALD J. QUIGG

*Attesting Officer* *Commissioner of Patents and Trademarks*